US007603198B2

(12) United States Patent
Chiari

(10) Patent No.: US 7,603,198 B2
(45) Date of Patent: Oct. 13, 2009

(54) METHOD OF POSITIONING THIN FLAT OBJECTS IN A PROCESSING MACHINE

(75) Inventor: Mauro Chiari, Denges (CH)

(73) Assignee: Bobst S.A (CH)

( * ) Notice: Subject to any disclaimer, the term of this patent is extended or adjusted under 35 U.S.C. 154(b) by 0 days.

(21) Appl. No.: 11/538,665

(22) Filed: Oct. 4, 2006

(65) Prior Publication Data

US 2007/0093370 A1 Apr. 26, 2007

(30) Foreign Application Priority Data

Oct. 5, 2005 (EP) ..... 05021708

(51) Int. Cl.
*G06F 7/00* (2006.01)

(52) U.S. Cl. ..... 700/218

(58) Field of Classification Search ..... 700/218, 700/230

See application file for complete search history.

(56) References Cited

U.S. PATENT DOCUMENTS 4,731,856 A * 3/1988 Lloyd et al. ..... 382/141
5,807,222 A 9/1998 Totani ..... 493/22
6,229,606 B1 * 5/2001 Way et al. ..... 356/364
6,229,608 B1 * 5/2001 Morris ..... 356/623
6,579,052 B1 * 6/2003 Bonora et al. ..... 414/222.01
7,243,003 B2 * 7/2007 Rice et al. ..... 700/245

FOREIGN PATENT DOCUMENTS

| | | |
|---|---|---|
| CH | 690470 | 9/2000 |
| EP | 448943 | 10/1991 |
| EP | 1044908 | 10/2000 |

* cited by examiner

*Primary Examiner*—Gene Crawford
*Assistant Examiner*—Ramya Prakasam
(74) *Attorney, Agent, or Firm*—Ostrolenk Faber LLp

(57) ABSTRACT

Method of positioning thin flat objects within a processing machine comprising an inserter for positioning these objects in a plurality of gripper members belonging to a conveyor drawing them discontinuously through successive stations. This method consists in calculating, for each of the gripper members, variations in the positioning distance of these members relative to a reference position, assigning these variations to the respective gripper members, and incorporating them into a primary procedure of the controller to improve the positioning of the thin flat objects in the gripper members.

10 Claims, 2 Drawing Sheets

METHOD OF POSITIONING THIN FLAT OBJECTS IN A PROCESSING MACHINE

CROSS REFERENCE TO RELATED APPLICATIONS

This application claims the benefit of the filing date of European Patent Application No. 05021708.2 filed 5 Oct. 2005, the disclosure of which is hereby incorporated by reference.

BACKGROUND OF THE INVENTION

The present invention relates to a method of positioning thin flat objects in a processing machine.

Such machines are used particularly in the printing and packaging industry, for example for making cartons from thin flat objects such as preprinted sheets. These sheets are taken from a stack situated upstream of the machine and passed into an insertion station by an inserter so that they can be positioned in clamping bars connected at regular intervals to a subsequent endless chain drive. The latter takes the sheets through the various later processing stations of the machine. Such stations typically cut the sheets, eject the cut waste, and collect these sheets in a stack.

In discontinuous transport, the chain drive moves and stops periodically in such a way that, during each movement, all the clamping bars gripping a sheet are moved from one station to the next station downstream. If good-quality printing or production is desired, the positioning of the sheets within the various successive stations is an operation of the utmost importance. If a printed sheet is to be cut, it will be realized that the sheet has to be positioned with great accuracy in the cutting station: care must be taken to ensure that the cutting tools, for example the cutting blank of a flat bed die press, is in perfect register with the image previously printed on the sheet.

Patent CH 690 470 describes a device for ensuring the quality of production of a press for producing packaging. For this purpose the device comprises a video camera designed to read not only the print-related reference marks but also a mark designed as a reference for the cutting position. These reference marks are placed on the front waste of the sheet which is held by the clamping bar. The cutting mark is made by a perforator connected to the cutting tools. This perforator makes a hole in the front waste of the sheet at the same time as the sheet is being cut. Further downstream another device marks sheets identified by the camera as defective, namely sheets with an out-of-tolerance divergence between the printed image and the cutting.

In patent EP 448 943, reference is made to clamping bars connected at their ends to the chains of the conveyor by so-called "floating" attachment systems. These attachment systems allow each clamping bar to be stopped and immobilized momentarily in a position rigorously determined in each station by means of a mechanical clamping system and by means of the elastic floating between the clamping bar and the chain drive. By means of such a system the thin flat object can be positioned with great accuracy, both at the moment of its insertion into the clamping bar and at each of the processing stations in which this system can be used to keep the bar in perfect register with the tools of this station.

However, such a system has the disadvantage, either of not being applicable to all machines, or of not being the most appropriate system which could be fitted to certain types of machines, notably machines handling corrugated board.

Patent EP 1 044 908 relates to a device and method for positioning thin flat objects in an insertion station. From a shelf situated in a rear starting position, this method consists in engaging means for fixing a thin flat object on the shelf and then causing actuators to move it forwards on the basis of the position of the thin flat object on the shelf. As a result, the front edge of the thin flat object is brought towards, stopped and then released in a predetermined position in the clamps of the clamping bar of the conveying device before the shelf has been finally returned to the starting position. To allow the shelf to be moved an appropriate distance forwards, if necessary sideways or obliquely, optoelectronic means read the coordinates of the position of the thin flat object and work out the necessary movement to position it correctly in the clamping bar.

Although optimized to position the thin flat object in the clamping bar on the basis of its initial starting position, very visible errors have nonetheless been found between the printed image and the cutting performed on these objects in machines fitted with such devices. These errors, both lateral and longitudinal, persisted in spite of the fact that the positions of the thin flat objects had been calculated correctly from the print-related reference marks, which themselves had been read properly by the optoelectronic means.

SUMMARY OF THE INVENTION

The object of the present invention is to remedy, at least in part, the above disadvantages in order to improve the positioning of thin flat objects in gripper members. In particular, the object is to ensure that there can be no errors of registration between the different operations performed on these objects in the subsequent stations of the machine.

To this end, the present invention relates to a method of positioning thin flat objects, in a processing machine, in accordance with claim 1.

A clearer understanding of the invention will be gained from a study of an implementation presented without implying a limitation and illustrated in the appended figures, in which:

To avoid any confusion in the following description, the terms "upstream" and "downstream" will be defined in terms of the direction of travel of the thin flat objects as illustrated by the arrow D in the figures. These objects move from the upstream to the downstream end, generally following the main axis X of the machine in a movement broken by periodic stops. Also, note that the adjectives "longitudinal", and "lateral" will be defined in relation to this main axis X.

DESCRIPTION OF A PREFERRED EMBODIMENT

Figure 1:
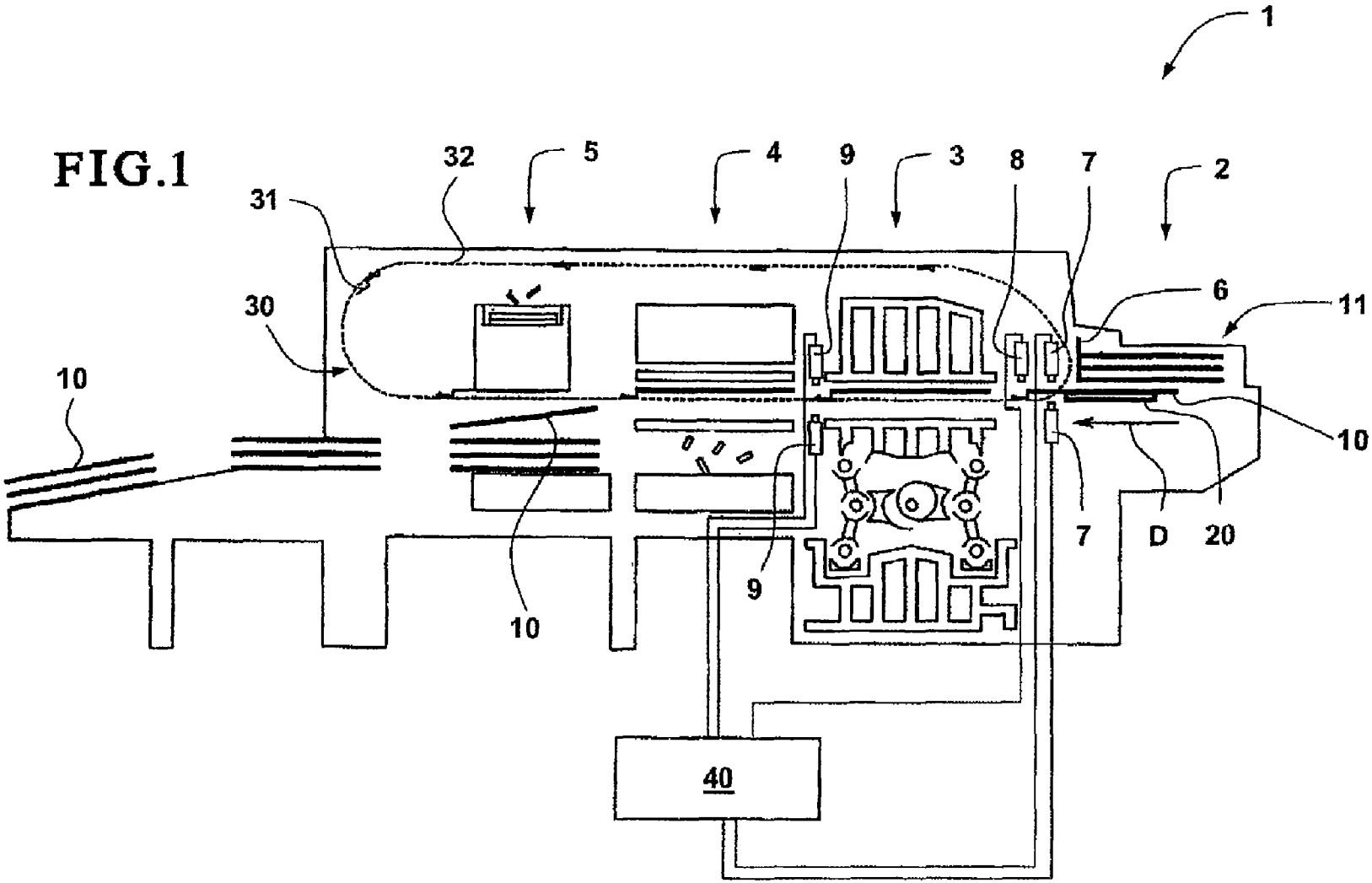
FIG. 1 is a diagrammatic representation of a processing machine through which thin flat objects are conveyed by clamping bars.

FIG. 1 shows a diagrammatic general view of a processing machine 1 in which the method of the present invention can be applied. This machine comprises a series of processing stations typically including an insertion station 2 followed by a cutting station 3, a waste ejection station 4 and a receiving station 5. The number and type of processing stations can vary according to the complexity of the production operations to be performed on the thin flat objects 10.

In the insertion station 2, the objects are arranged in a stack 11. It is generally pressed against a gage 6 which also acts as a front stop for these objects. Because of the gap left at the bottom of the gage 6, the objects can be removed one by one from the bottom of a stack 11 by means of an inserter 20. This device will insert each object into a gripper member 31 belonging to a conveyor 30, as shown more clearly in FIG. 2. This conveyor generally consists of a chain drive 32, between the chains of which are a plurality of clamping bars each acting as a gripper member 30 for the thin flat object 10.

The chain drive 32 moves and stops periodically so that during one movement each gripper member 31 has moved from one station to the next station downstream. The positions at which the gripper members stop are dictated by the chain drive moving a constant distance. This distance corresponds to the theoretical pitch of these members on the chain drive. The processing stations 2, 3, 4 and 5 are set at fixed distances at the same pitch so that at each stop the gripper members 31 are in register with the tools of these stations.

Figure 2:
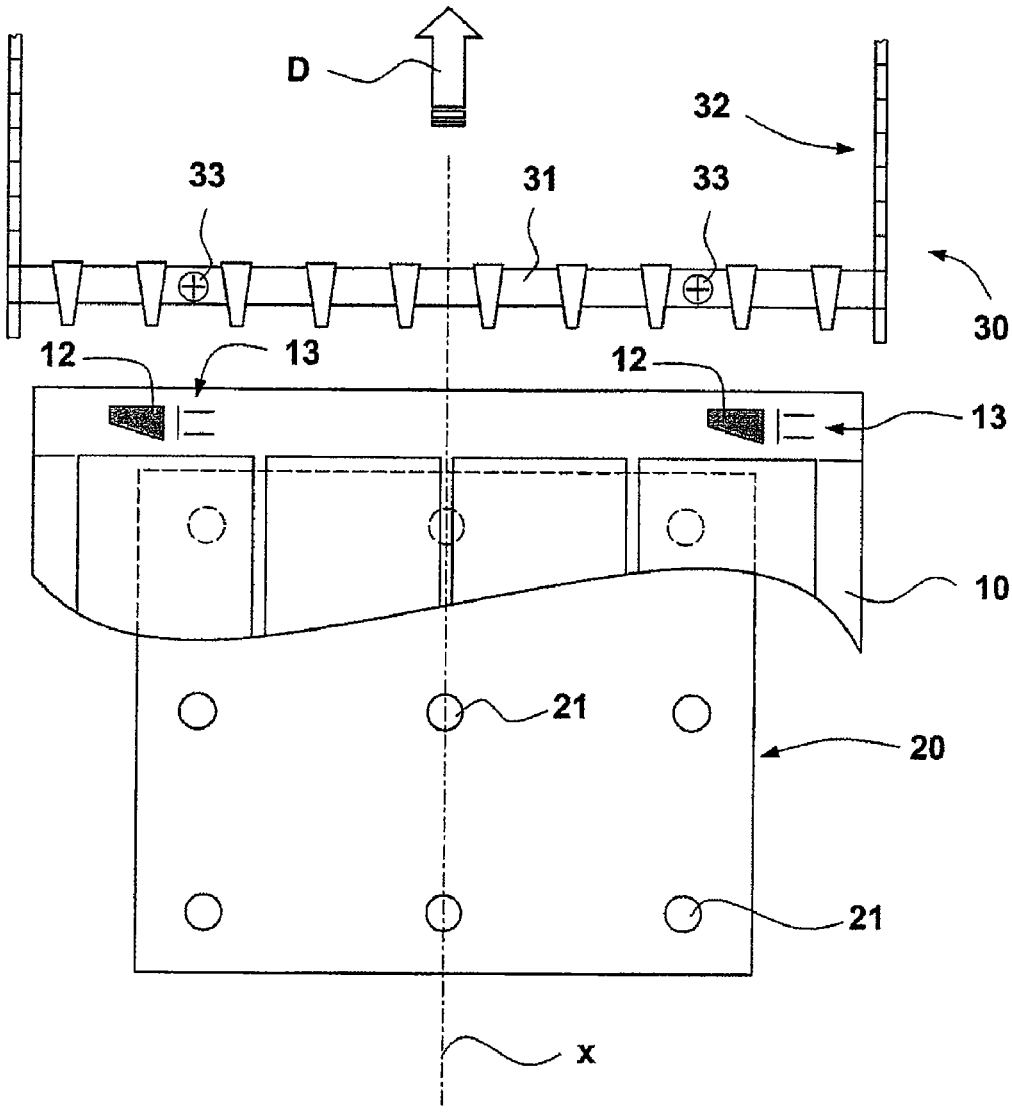
FIG. 2 is a diagrammatic plan view of the front edge of a thin flat object moving towards a clamping bar, which will then grab it.

With reference to FIG. 2, this diagram shows, in a diagrammatic top view, a downstream portion of a thin flat object 10 being moved towards a clamping bar by the inserter 20. Such an inserter may, for example, be a vacuum plate 21. This vacuum plate attracts the bottommost thin flat object of the stack 11, slides it underneath the gage 6, and places it in a defined position gripped by the grippers of the gripper member 31. The path of the inserter 20 depends on the initial position of the thin flat object 10 at the bottom of the stack. This position is detected by first sensors 7 situated directly downstream of the gage 6 (FIG. 1). A pair of these sensors will preferably be arranged above the plane on which the thin flat objects pass, and another pair below. With this arrangement it becomes possible to read printed marks 12 (FIG. 2) for registering a printed image formed on either the recto or the verso side of the thin flat object. Such reference marks are generally made at its front end, that is on the front waste used by the gripper member to grip the thin flat object.

As soon as the initial position of the thin flat object has been detected by the said first sensors 7, this position is immediately transmitted to a controller 40 for the path of the inserter 20 to be calculated. Given the theoretical position of stoppage of the gripper member 31 in the insertion station, the controller is therefore able to work out the values of the parameters of the movement (lateral, longitudinal or skew) of the inserter, so that the latter can advance the thin flat object it is conveying in the gripper member correctly on the basis of its initial starting position. The calculations are performed in a primary procedure that also enables the controller 40 to control the inserter 20.

Drawn by the gripper member into the cutting station 3, the thin flat object will then be cut by a die corresponding to the developed shape which it is wished to produce, for example to produce a plurality of boxes of a given shape. In this station, or in one or more further stations, other operations can also be performed, such as the compressing of fold lines, the embossing of certain surfaces and/or the application of motifs from metalized strips, for example. To produce a high-quality product, it is necessary both that all these operations be performed in perfect register with each other, and also that their registration also be in register with the printed image, in the case in which the processed thin flat objects have previously been printed.

In spite of the application of the said primary positioning procedure, errors of registration between these operations and the existing printed image on the thin flat objects have nevertheless been found. It has also been observed that this frustrating problem usually occurs when the chain drives are beginning to age or have been subjected to shocks as a result of jams, for example. The explanation of these errors of registration will be seen from the following.

The distance between two consecutive gripper members 31—in the present case two adjacent clamping bars—should be constant and equal for all the gripper members of the conveyor. This is true for example when the chain drive is new or when the machine to which it is fitted is new. However, for various reasons this distance may either vary with the passage of time, or vary suddenly in response to various events. This variation may also be irregular, creating different distances between the gripper members. After examining all the causes, it was found that wear, shocks or excessive variations in the temperature of the conveyor were to blame for such variations. Despite their harmful effects on the registration of the operations performed on the thin flat objects, such variations have however never yet been taken into account.

When the conveyor and/or gripper members have reached a certain normal level of wear, their component parts have a tendency to depart further and further from the original tolerances to which they were machined or constructed. A chain drive will usually tend to stretch, thus changing the initial pitch of the clamping bars. However, such faults do not develop in the longitudinal direction only but can also be produced transversely or askew relative to the main machine axis X. Shocks, stresses or heavy jerking can stretch the links of the chain drive or introduce what are at first sight undetectable displacements of one or more clamping bars.

Because faults in the positioning of the gripper members 31 in the conveyor 30 can be independent of each other, it is important to assign to each of these members the variations corresponding to its positioning error relative to its initial reference position.

Using the subject of the present invention it becomes possible to allow for these variations in the controller 40 which operates the inserter 20, and therefore correct systematic errors and improve the positioning of the thin flat objects in each of the gripper members.

The first main step of the resulting positioning method is to calculate, for each of the gripper members 31, variations in the positioning distance of these members in the various processing stations 2, 3, 4, 5. These variations are defined relative to a known reference position in coordinates in a Cartesian reference system for example. For this purpose, the position of at least one reference point 33 fixed to the gripper member, as illustrated in FIG. 2, will be measured. This reading could be taken easily using at least one second sensor 8, as shown in FIG. 1.

By comparing this reading with the reference position, the variation in the positioning distance will be determined. This variation can be quantified by at least one value, preferably a pair of values defined in terms of the said Cartesian coordinate system, in which case the reference position would advantageously be defined in the same system by original values taken by default.

In the preferred embodiment the calculations of the said variations are performed in the course of an initial phase before the thin flat objects 10 are processed. This initial phase can typically take place when the machine is being initialized during set up, for example. During this initial phase the conveyor 30 will be made to carry out one complete revolution in the machine, so that all the gripper components 31 can pass under the second sensor or sensors 8. Thus, the determination of the variation of the positioning distance of each of the gripper members is performed once only. However, it may be advisable to take several redundant readings so that the measured positions of the gripper members is an average of more than one reading of each reference point 33. Such a result could be obtained by making the conveyor 30 perform more than one revolution during the initial phase.

In the envisaged implementation, the readings are taken while the gripper members are in motion rather than when they are at rest. The reason for this is simply that there is too little space inside the machine to install the second sensors 8 above the gripper member when it is at rest in the station in question.

When the readings are taken "on the fly" in this way, it is also envisaged that several additional parameters be taken into account, such as the speed and acceleration, positive or negative, of the moving member 31 at the moment of the reading. These values will enable factors such as the inertia of the gripper members and the resulting elastic deformations to be taken into account. By slightly modifying the value of the reading compared with what it should be if it had been taken at rest, these additional parameters are preferably incorporated into the calculations of the variations of the positioning distances of the gripper members 31 in the cutting station 3.

The second main step in the method of the present invention is to assign the said calculated variations to each of the corresponding gripper members. One way of assigning them may be to store the values of these distance variations in correlation with a system of reference of the gripper members. Such a system of reference would have the purpose of identifying and distinguishing each of the gripper members from the others. This system may be relative or absolute. In the case of a relative system, it is sufficient to know the number of gripper members 31 in the conveyor 30 and to number these members incrementally beginning with the first gripper member to be detected by the second sensor 8. In the case of an absolute system, each gripper member will be identified by a permanent identification number unique to that member. This second solution therefore requires that each of the members be identified, which is advantageously unnecessary in the first system of reference. By using either one or the other of these systems it is possible to allocate and store in the controller 40 at least one distance variation for each of the gripper members.

The third main step of the said method is to incorporate the variations in the positioning distances of the gripper members in the primary procedure of the controller 40 in order to improve the positioning of the thin flat objects 10 in the gripper members. Such incorporation allows an initial use to be made of the calculated variations, and even the use of corresponding corrective values, which have to be taken into account to compensate for the observed positioning faults of each of the gripper members. In this way the controller will be able to modify the positioning coordinates (initially determined by the first sensors 7) which the inserter 20 must achieve at the end of each of its strokes.

For its last step, the method of the present invention can also include checking the positioning of each of the thin flat objects by measuring the relative positions of at least two production marks. A third sensor 9, preferably at least a pair of sensors 9 arranged on either side of the plane along which the thin flat objects 10 pass, downstream of the cutting station 3, can perform this check.

For this purpose it is envisaged that at least one cut mark 13 be made in the front waste of the thin flat object, preferably not far from the printed mark 12. In the method of the present invention, the cut marks 13 are preferably incisions in the thin flat object. One or more incisions, as illustrated in FIG. 2, can be made by blades provided for this purpose only. These incisions appear on the thin flat object as a simple cut line and are produced simultaneously with the cutting operation in the corresponding station. This process of producing very fine cut marks 13 has the advantage of generating no waste, unlike the cut marks produced hitherto by perforation.

The cut marks 13 and the printed marks 12 act as production marks which can be read—both by the same sensor 9—through a reading window at a given instant. When the marks are brought together, they can be used to assess the quality of manufacture of each thin flat object. The use of at least two of these sensors 9 also makes it possible to detect any fault of parallelism, for example between the printing and cutting operations.

If one of the third sensors 9 detects such a fault or too great a divergence between two different production marks, the defective thin flat object could for example be sent to a reject station provided downstream especially for this purpose. Such a station (not shown in FIG. 1) would enable defective thin flat objects to be ejected by a known operation identical to that of the receiving station 5. However, this does not rule out the alternative of removing defective objects by hand once they arrive in the receiving station.

Advantageously, the method of the present invention also makes it possible to collect data for statistical purposes. Information about the measurements of the positioning variations of the gripper members, and out-of-tolerance errors and/or the measurements of the relative positions of two production marks 12, 13 may for example be written to a data file for subsequent use of these data.

Advantageously again, this method makes it possible to extend the life of the conveyor 30, because although the strength of a worn chain drive generally remains amply sufficient, the elongation of certain of its parts formerly meant that it had to be replaced periodically in its entirety to maintain and ensure quality production. Now, with the possible variations in the pitch of the clamping bars being taken into account, the working life of such a chain drive can be extended without compromising the quality of the output thin flat objects.

Another advantage of the present invention is that this method can be used in place of the mechanisms of the prior art employed to lock the gripper members connected to the conveyor by floating attachment systems. As a result, it becomes possible to dispense with those relatively complicated and expensive mechanisms, which furthermore had to be fitted to all of the gripper members.

Finally, it should be pointed out that the readings taken of the variations of positioning of the gripper members 31 can be due equally to longitudinal, lateral or skew positioning errors. An error corresponding to a skewed positioning of the gripper members could be the result of a different elongation of one chain with respect to the other, or abnormal wear of the drive members of one of the two chains. In this situation the thin flat objects adopt a trailing position for which the subject of the present invention is able to compensate completely during the positioning of these objects in the gripper members.

The invention claimed is:

1. A method for positioning of thin flat objects by a machine having an inserter element a controller and a conveyor including a plurality of gripper members, the machine configured for conveying and positioning the thin flat objects successively to the plurality of gripper members, the inserter element inserting a first thin flat object of the thin flat objects into a first gripping member of the plurality of gripping members and inserting a second thin flat object of the thin flat objects into a second gripping member of the plurality of gripping members, the first and second gripper members, respectively, thereafter drawing the first and second thin flat objects to one or more processing stations of the machine, the process comprising:

detecting an initial position of each of the first and second thin flat objects in the machine;

transmitting the detected initial position for each of the first and second thin flat objects to the controller;

calculating a movement path of the inserter element for each of the first and second gripping members;

controlling the inserter element to insert the first and second thin flat objects, respectively, into the first and second gripper members; and conveying and positioning the first and second thin flat objects by, respectively, the first and second gripper members to the one or more processing stations, wherein the controlling of the inserter element comprises:

setting a reference position relative to the conveying and positioning movement for each of the first and second gripper members;

determining a first deviation variation from normal movement and a second deviation variation from normal movement, respectively, for each of the first and second gripper members relative to the reference position for each of the first and second gripper members, the deviation variation from normal movement being a deviation resulting from wear over time, respectively, of the first and second gripper members;

assigning each of the first and second deviation variations from normal movement to the first and second gripper members, respectively, and providing the assigned deviation variations to the controller; and controlling the inserter element by the controller to convey and position the first thin flat object by the first gripper member based on the detected initial position of the first thin flat object and based on the assigned deviation variation from normal movement of the first gripper member; and controlling the inserter element by the controller to convey and position the second thin flat object by the second gripper member based on the detected initial position of the second thin flat object and based on the assigned deviation variation from normal movement of the second gripper member.

2. The method according to claim 1, wherein the determining of the first and second deviation variations of movement, respectively, for the first and second gripper members is performed by measuring the position of at least one reference point on each gripper member and comparing the measured position of the reference point with the reference position.

3. The method according to claim 2, wherein the position of the reference point is measured at least twice and the deviation variations of movement of a respective gripper member is an average of all measurings of the position of the reference point of the respective gripper member relative to the reference position.

4. The method according to claim 2, wherein the measuring of the position of the reference point is taken while the gripper members are in motion on the conveyer.

5. The method according to claim 4, wherein the determining of deviation variations of movement includes incorporation of speed and acceleration values for the motion of each of the gripper members.

6. The method according to claim 1, wherein the determining of the first and second deviation variations of movement is performed with an operation of the machine before the thin flat objects are processed.

7. The method according to claim 1, wherein the assigning of the deviation variations of movement to each of the gripper members is performed by storing the variations of movement in correlation to the respective gripper members in a reference system for the gripper members.

8. The method according to claim 7, wherein the reference system for the gripper members is a relative system of the gripper members that is a function of a total number of gripper members.

9. The method according to claim 1, wherein the positioning of the thin flat objects is verified as a final step by measuring at a processing station of the one or more processing stations relative positions of at least two production marks on each thin flat object, at least one of the production marks being made by an incision in the thin flat object in a previous processing station of the one or more processing stations.

10. A controller for positioning of thin flat objects by a machine having an inserter element and a conveyor including a plurality of gripper members the inserter element configured to convey and position the thin flat objects successively to the plurality of gripper members by individually inserting the thin flat objects into respective gripping members, each of the respective gripper members being configured to grip a respective thin flat object of the thin flat objects to convey the respective thin flat object to at least one processing station of the machine, the controller being configured:

to receive a detected initial position of a first thin flat object of the thin flat objects in the machine and to receive a detected initial position of a second thin flat object of the thin flat objects in the machine;

to calculate a movement path of the inserter element for each of the first and second thin flat objects; and to control the inserter element to insert the first and second thin flat objects into, respectively, the first and second gripper members for conveying and positioning the first and second thin flat objects by the respective gripper members to the processing stations;

the controller further being configured to compensate for deviation variations of movement of the first and second gripper elements, such that the controller is configured:

to set a reference position relative to conveying and positioning movement for each of the first and second gripping members;

to determine a first deviation variation and a second deviation variation from normal movement, respectively, for the first and second gripper members relative to the reference position for each of the first and second gripping members, the deviation variation from normal movement being a deviation resulting from wear over time, respectively, of the first and second gripper members;

to assign each of the first and second deviation variations from normal movement, respectively, to the first and second gripper members and and to provide the the assigned deviation variations to the controller; and to control the inserter element to convey and position the first thin flat object by the first gripper member based on the detected initial position of the first thin flat object and based on the assigned deviation variation from normal movement of the first gripper member; and to control the inserter element to convey and position the second thin flat object by the second gripper member based on the detected initial position of the second thin flat object and based on the assigned deviation variation from normal movement of the second gripper member.

* * * * *